US005988213A

United States Patent [19]

Yoshioka

[11] Patent Number: 5,988,213

[45] Date of Patent: Nov. 23, 1999

[54] VEHICULAR FUEL SUPPLYING APPARATUS

[75] Inventor: Hiroshi Yoshioka, Tokyo, Japan

[73] Assignee: Mitsubishi Denki Kabushiki Kaisha, Tokyo, Japan

[21] Appl. No.: 08/903,728

[22] Filed: Jul. 31, 1997

[30] Foreign Application Priority Data

Jan. 31, 1997 [JP] Japan ..... 9-018404

[51] Int. Cl.[6] ..... F02M 37/04

[52] U.S. Cl. ..... 137/590; 137/565.15; 123/509; 123/510

[58] Field of Search ..... 123/509, 510; 137/565.01, 565.15, 590

[56] References Cited

U.S. PATENT DOCUMENTS 5,195,494 3/1993 Tuckey ..... 123/510
5,623,910 4/1997 Riggle ..... 123/510

FOREIGN PATENT DOCUMENTS 1-37178 11/1989 Japan .

*Primary Examiner*—A. Michael Chambers
*Attorney, Agent, or Firm*—Sughrue, Mion, Zinn, Macpeak & Seas, PLLC

[57] ABSTRACT

A vehicular fuel supplying apparatus comprising an in-tank type fuel pump mounted within the fuel tank from an opening in a bottom wall of a fuel tank. A fuel flowing out prevention valve 21 is connected between a discharge port 7*a* of a fuel pump 7 and a vehicle body side pipe 16 to an engine. A valve 25 seating on a seal surface and having a coil spring 28 is disposed within the fuel flowing out prevention valve 21 to provide a valve function, the valve opening pressure of the fuel flowing out prevention valve 21 from the side of the fuel pump is set to be greater than a total maximum value of a fuel head pressure inside of the fuel tank and an internal pressure of the fuel tank and is set smaller than a fuel discharge pressure at the fuel pump 7.

3 Claims, 7 Drawing Sheets

VEHICULAR FUEL SUPPLYING APPARATUS

BACKGROUND OF THE INVENTION

This invention relates to an in-tank type vehicular fuel supplying apparatus which is mounted from the bottom wall of a fuel tank.

FIG. 7 illustrates a conventional vehicular fuel supplying apparatus disclosed in Japanese Patent Laid-Open No. 1-37178, in which the fuel supplying apparatus is mounted to the bottom wall of a fuel tank and is positioned within the fuel tank.

In the figure, the reference numeral 1 is a fuel tank, of which bottom wall has formed therein an opening 2. 3 is a packing disposed around the opening 2, 4 is a set plate oil-tightly attached to the opening 2 through the packing 3. 5 is a sub tank secured to the tank inner surface of the set plate 4, and an in-tank type fuel pump 7 is mounted to a pump holder 6 secured to the inner bottom surface of the sub tank 5. 8 is a filter disposed at the suction port 7*b* of the fuel pump 7. 10 is a supply pipe connected through a rubber hose 9 to a discharge port 7*a* of the fuel pump 7, the supply pipe 10 being bent into a substantially U-shape and oil-tightly connected and extending through the set plate 4 and being connected to a vehicular body pipe 16 directed to an engine by means of a joint 14. 11 is a power line to the fuel pump 7, which extends from the power supply terminal 13 to a connector 12 oil-tightly connected through the set plate 4.

The operation of the conventional vehicular fuel supply apparatus will now be described.

By driving the fuel pump 7 by a voltage applied from the power supply terminal 13 through the connector 12 and the power supply line 11, the fuel 15 in the fuel tank 1 is sucked through the filter 8 and pressurized by the fuel pump 7 and supplied to the vehicle body side pipe 16 directed to the engine through the supply pipe 10.

In the above-described conventional vehicular fuel supply apparatus, when the vehicle body side pipe 16 is disconnected from the joint 14 of the supply pipe 10 for the vehicle body maintenance or the like, a jet of the fuel 15 from the supply pipe 10 is generated due to the head pressure H of the fuel 15 within the fuel tank 1 and pressure P inside of the fuel tank 1, causing the fuel to out and scatter to disadvantageously degrade the maintenance working efficiency.

In order to cope with this problem, another conventional vehicular fuel supplying apparatus as shown in FIG. 8 has been proposed in which a fuel cock 18 is installed in the midway of the supply pipe 10 at the position under the set plate 4 so that the fuel cock 18 may be closed when the fuel supply pipe 10*a* is to be disconnected from the vehicular body side pipe 16. However, because the added fuel cock 18 must be manually operated, the fuel pump 7 may sometimes be driven with the fuel cock 18 inadvertently left closed after the supply pipe 10*a* has been reassembled to the vehicular body side pipe 16, generating an abnormal pressure rise within the supply pipe 10 which may cause a failure of the fuel pump 7.

SUMMARY OF THE INVENTION

Accordingly, one object of the present invention is to provide a vehicular fuel supplying apparatus which is free from the above discussed problems.

Another object of the present invention is to provide a vehicular fuel supplying apparatus in which the fuel does not scatter upon disconnecting the supply pipe from the vehicular body side pipe and in which no pressure abnormal built up within the fuel supply pipe occurs after re-assembling the supply pipe to the vehicular body side pipe.

With the above objects in view, the vehicular fuel supplying apparatus of the present invention is characterized in that a fuel flow prevention valve mounted between a discharge port of the fuel pump and a vehicle body side pipe to an engine is provided, and the valve opening pressure of the fuel flow prevention valve from the side of the fuel pump is set to be greater than a total maximum value of a fuel head pressure of the inside of the fuel tank and a pressure of the inside of the fuel tank and is smaller than a fuel discharge pressure generated by the fuel pump.

The vehicular fuel supplying apparatus of the present invention may comprise a fuel filter disposed within the fuel tank and on the downstream of the discharge port of the fuel pump. The fuel flowing out prevention valve may be disposed at the fuel outlet portion of the fuel filter.

The vehicular fuel supplying apparatus of the present invention may be arranged such that a fuel flowing out prevention valve mounted within a discharge port of the fuel pump is provided, and that a valve opening pressure of the fuel flowing out prevention valve from the side of the fuel pump is set to be greater than a total maximum value of a fuel head pressure of the inside of the fuel tank and a pressure of the inside of the fuel tank and is smaller than a fuel discharge pressure generated by the fuel pump.

The vehicular fuel supplying apparatus of the present invention may also be arranged such that the fuel flowing out prevention valve is disposed within the discharge port of the fuel pump, making the piping of the apparatus simple.

BRIEF DESCRIPTION OF THE DRAWINGS

The present invention will become more readily apparent from the following detailed description of the preferred embodiments of the present invention taken in conjunction with the accompanying drawings, in which.

DESCRIPTION OF THE PREFERRED EMBODIMENTS

Figure 1:
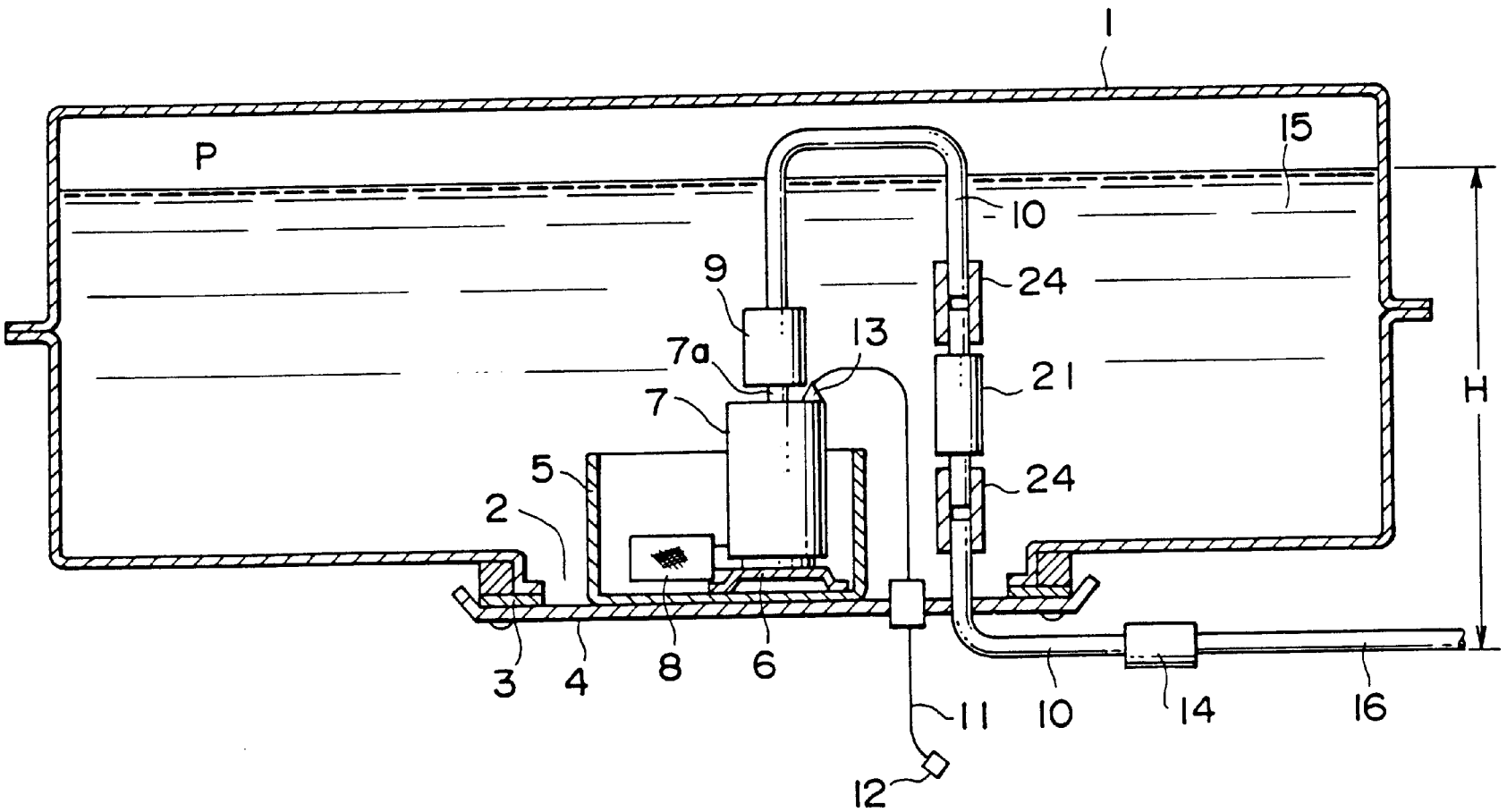
FIG. 1 is a sectional side view of the vehicular fuel supplying apparatus of the first embodiment of the present invention.
Figure 2:
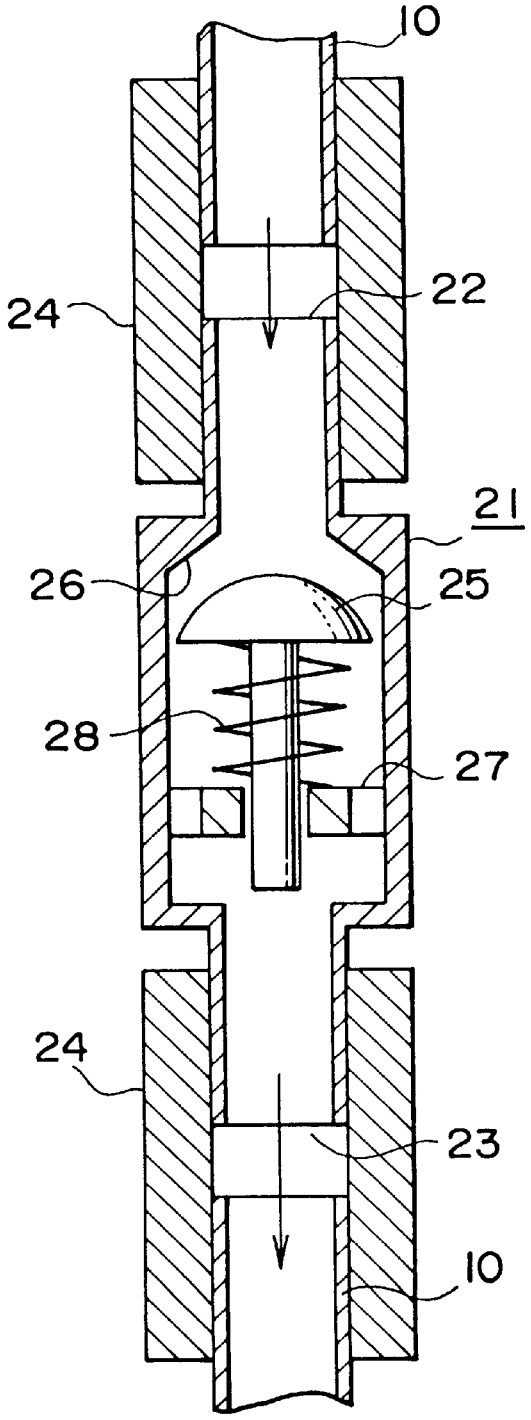
FIG. 2 is a sectional view of the fuel flowing out prevention valve of the first embodiment of the present invention.

FIG. 1 is sectional side view of a vehicular fuel supplying apparatus showing the first embodiment of the present invention and FIG. 2 is a sectional view of the fuel flowing out prevention valve. In the figures, reference numerals 1–16 are similar components to those explained in terms of the conventional apparatus shown in FIGS. 1 and 2 so that their description is omitted. Reference numeral 21 is a fuel flow prevention valve inserted by means of rubber hoses 24 into the supply pipe 10 between the discharge port 7*a* of the fuel pump 7 and the vehicular body side pipe 16. The fuel flow prevention valve 21 is provided at its respective ends with a fuel inlet 22 and a fuel outlet 23 each connected to the supply pipe 10 by means of the rubber hose 24. Within the fuel flow prevention valve 21, a valve 25 is disposed to close the seal surface 26 or the valve seat on the side of the fuel inlet 22 and is held in the flow path by a valve holder 27. Between the valve 25 and the valve holder 27, a compression coil spring 28 is disposed to urge the valve 25 against the valve seat 26. The valve opening pressure of the valve 25 provided by the coil spring 28 is set to be a predetermined value greater than a total maximum value of a head H of the fuel 15 inside of the fuel tank 1 and a pressure P of the inside of the fuel tank, but smaller than a fuel discharge pressure generated by the fuel pump 7.

In the vehicular fuel supplying apparatus of the above-described construction, when the fuel pump is not operated, even when the head pressure H of the fuel 15 within the fuel tank 1 and the pressure P within the fuel tank 1 are generated, the valve 25 of the fuel flow prevention valve 21 is urged against the seal surface 26 by the coil spring 28 and the flowing out of the fuel is blocked, so that, upon the disconnection of the vehicular body side pipe 16 from the joint 14 of the supply pipe 10 for the purpose of maintenance or the like of the vehicular body, the fuel does not flow out from the supply pipe 10 and a satisfactory working efficiency in maintenance can be maintained.

Also, when the fuel pump 7 is driven after the supply pipe 10 is assembled or connected again to the vehicular body side pipe, the valve 25 of the fuel flow prevention valve 21 is separated from the valve seat 26 against the action of the coil spring 28 by the fuel discharge pressure generated by the fuel pump 7, thus automatically opening the fuel flow prevention valve 21 and preventing the failure or damages of the fuel pump 7 due to the abnormal pressure rise within the supply pipe 10.

While, in the above first embodiment, the fuel flowing out from the disconnected fuel pipe is prevented by inserting the fuel flow prevention valve 21 into the middle of the supply pipe 10 between the discharge port 7*a* of the fuel pump 7 and the vehicular body side pipe 16, the fuel flow prevention valve may be disposed inside of the fuel outlet of the fuel filter mounted within the fuel tank 1 and achieve a similar operation.

Figure 3:
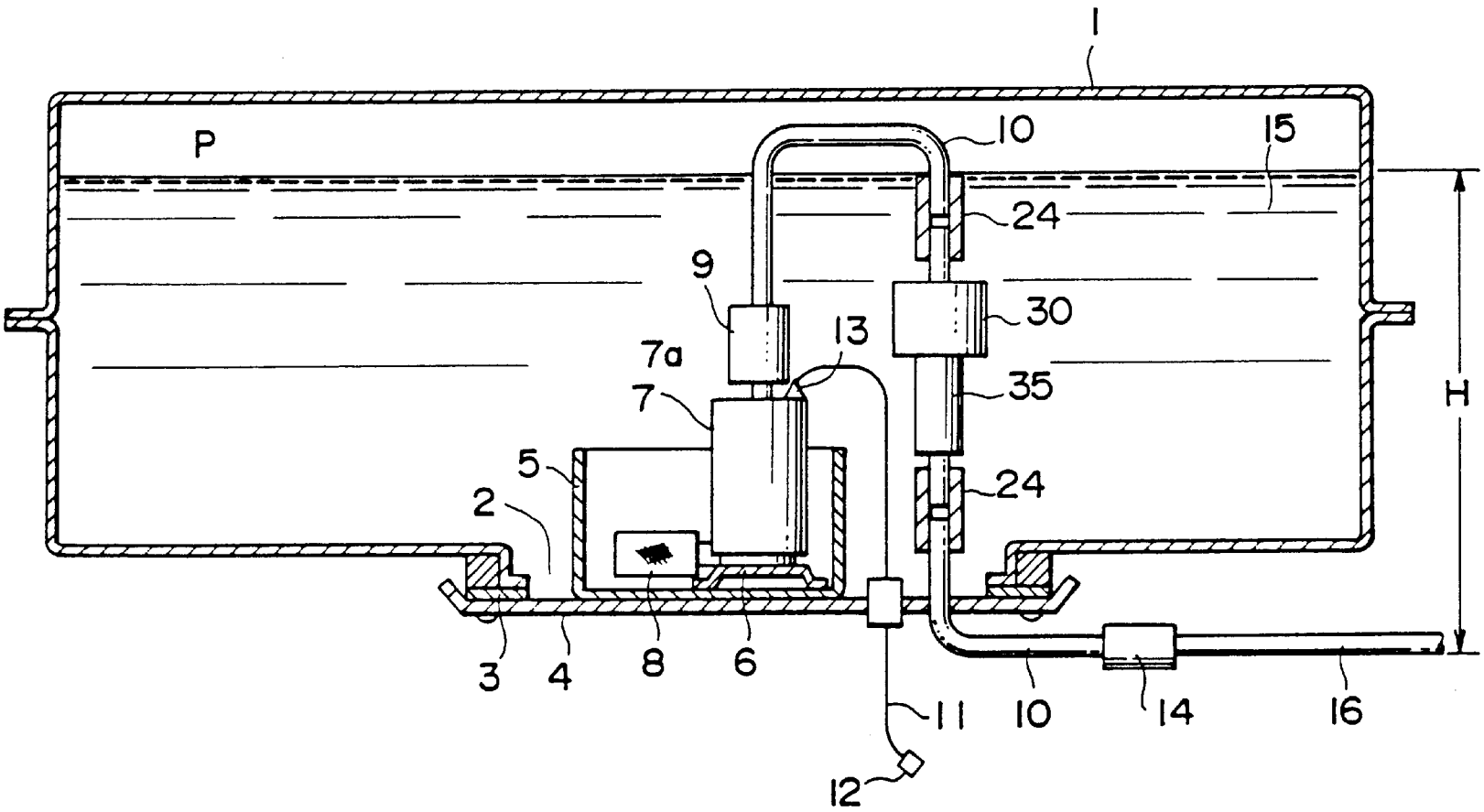
FIG. 3 is a sectional side view of the vehicular fuel supplying apparatus of the second embodiment of the present invention.
Figure 4:
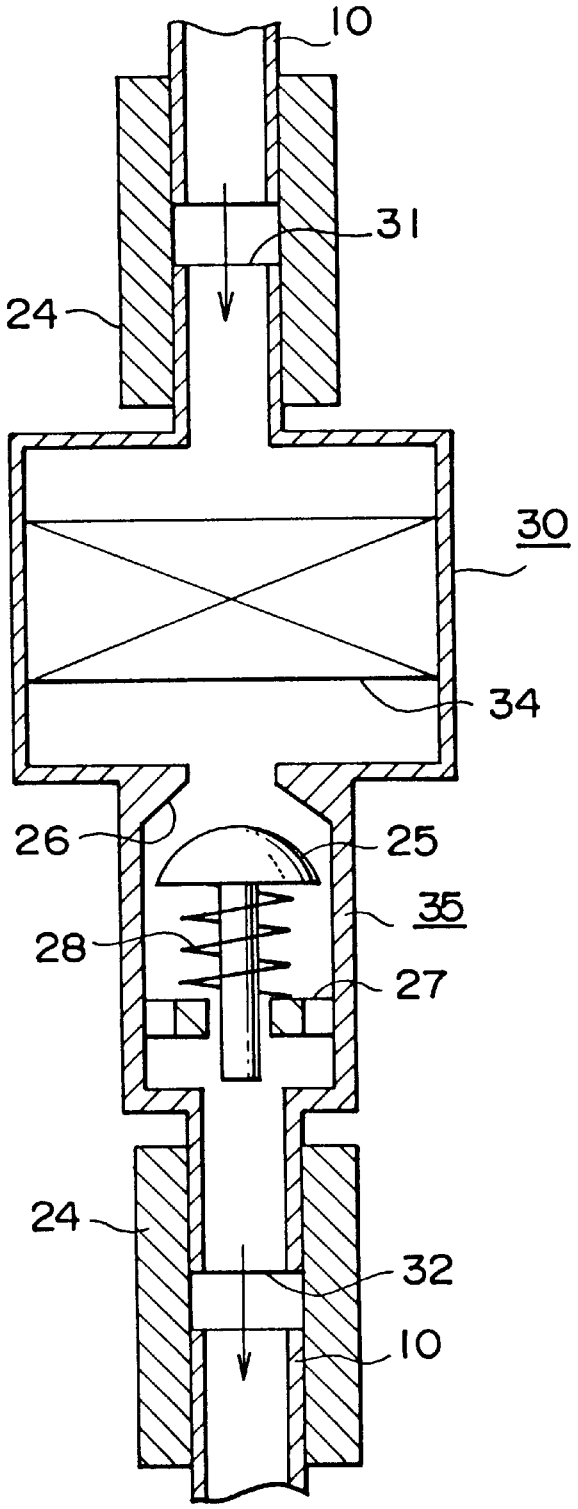
FIG. 4 is a sectional view of the fuel filter and the fuel flowing out prevention valve of the second embodiment of the present invention.

FIG. 3 is a sectional side view of the vehicular fuel supplying apparatus of the second embodiment of the present invention and FIG. 4 is a sectional view of the fuel filter and the fuel flowing out prevention valve. In the figures, reference numerals 1–16, 21 and 24–28 are similar components to those explained in conjunction with the above first embodiment. 30 is a fuel filter, which is disposed to the midportion of the supply pipe 10 within the fuel tank 1 and between the discharge port 7*a* of the fuel pump 7 and the vehicular body side pipe 16. 31 is a fuel inlet of the fuel filter 30 and 32 is a fuel outlet. 34 is a filtering paper for filtering the foreign matters entrained within the fuel flowing between the fuel inlet 31 and the fuel outlet 32. 35 is a fuel flow prevention valve, disposed between the fuel outlet 32 and the filtering paper 34 so that its seal surface can be brought into contact with the seal surface 26 of the side of the filter paper 34, and is held in the flow path by a valve holder 27. Between the valve 25 and the valve holder 27, a coil spring 28 is disposed to urge the valve 25 against the seal surface 26 at a predetermined pressure. The valve opening pressure of the valve 25 due to the coil spring 28 is set to be greater than the total maximum value of the head H of the fuel 15 inside of the fuel tank 1 and the pressure P of the inside of the fuel tank, and to be smaller than the fuel discharge pressure generated by the fuel pump 7.

Therefore, similarly to that described in terms of the above-described first embodiment, even upon the disconnection of the vehicular body side pipe 16 from the joint 14 of the supply pipe 10 for the purpose of maintenance or the like of the vehicular body, the fuel does not flow out from the supply pipe 10 and the damages of the fuel pump 7 due to the abnormal pressure rise within the supply pipe 10 when the fuel pump 7 is driven after the supply pipe 10 is assembled to the vehicular body side pipe can be prevented.

Also, in this second embodiment, the fuel is filtered by the filter paper 34 within the fuel filter 30 before it flows into the fuel flow prevention valve 35, so that the problem in which the dust or the like generated in the fuel pump 7 is caught between the valve 25 and the seal surface 26 and damages the sealing ability can be alleviated.

In the first embodiment, the fuel flow prevention valve 21 is inserted into the supply pipe 10 positioned between the discharge port 7*a* of the fuel pump 7 and the vehicular body side pipe 16 to prevent the flowing out of the fuel. However, in this third embodiment, the fuel flow prevention valve is disposed at the discharge port of the fuel pump to achieve similar operations.

Figure 5:
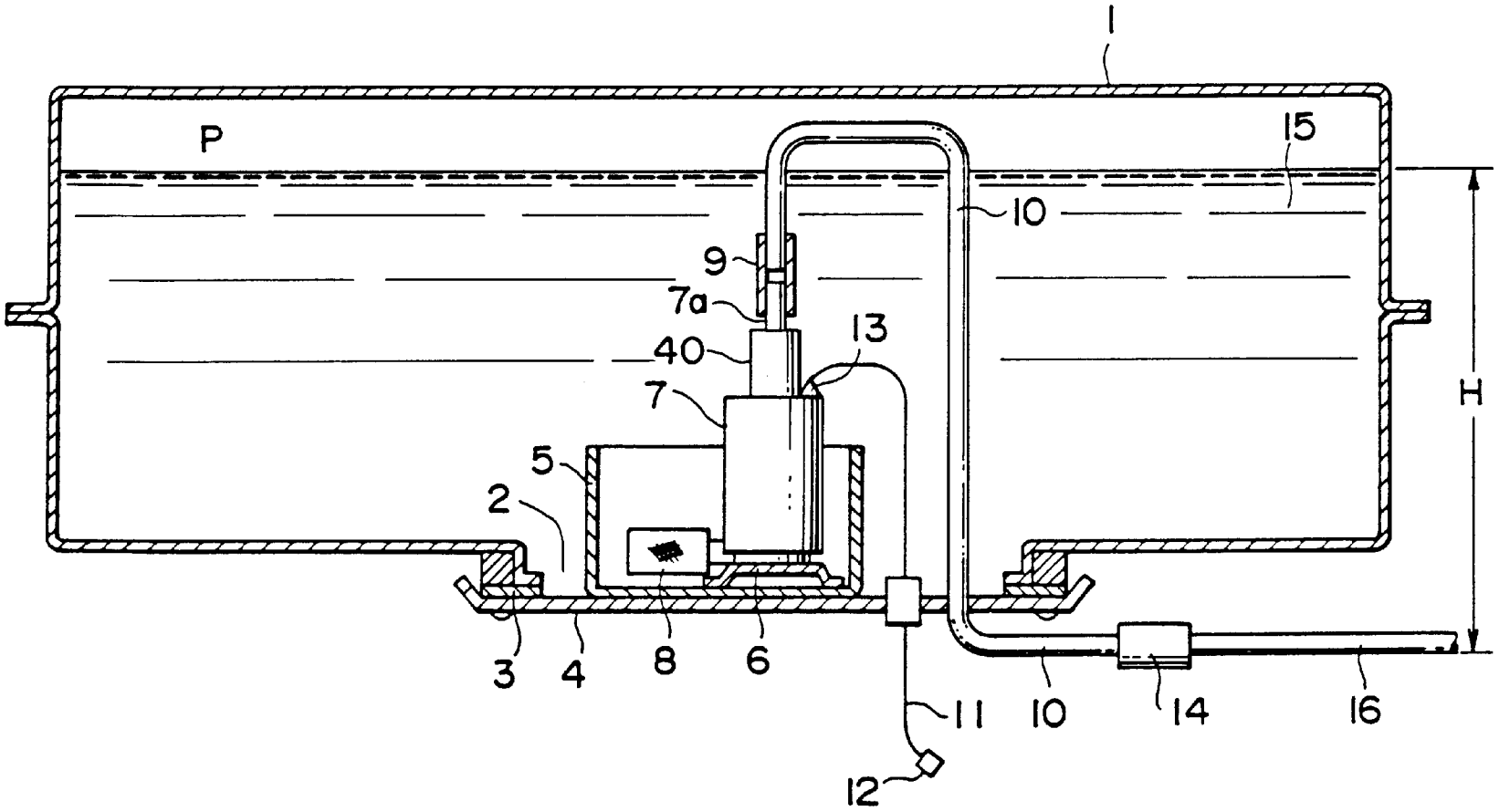
FIG. 5 is a sectional side view of the vehicular fuel supplying apparatus of the third embodiment of the present invention.
Figure 6:
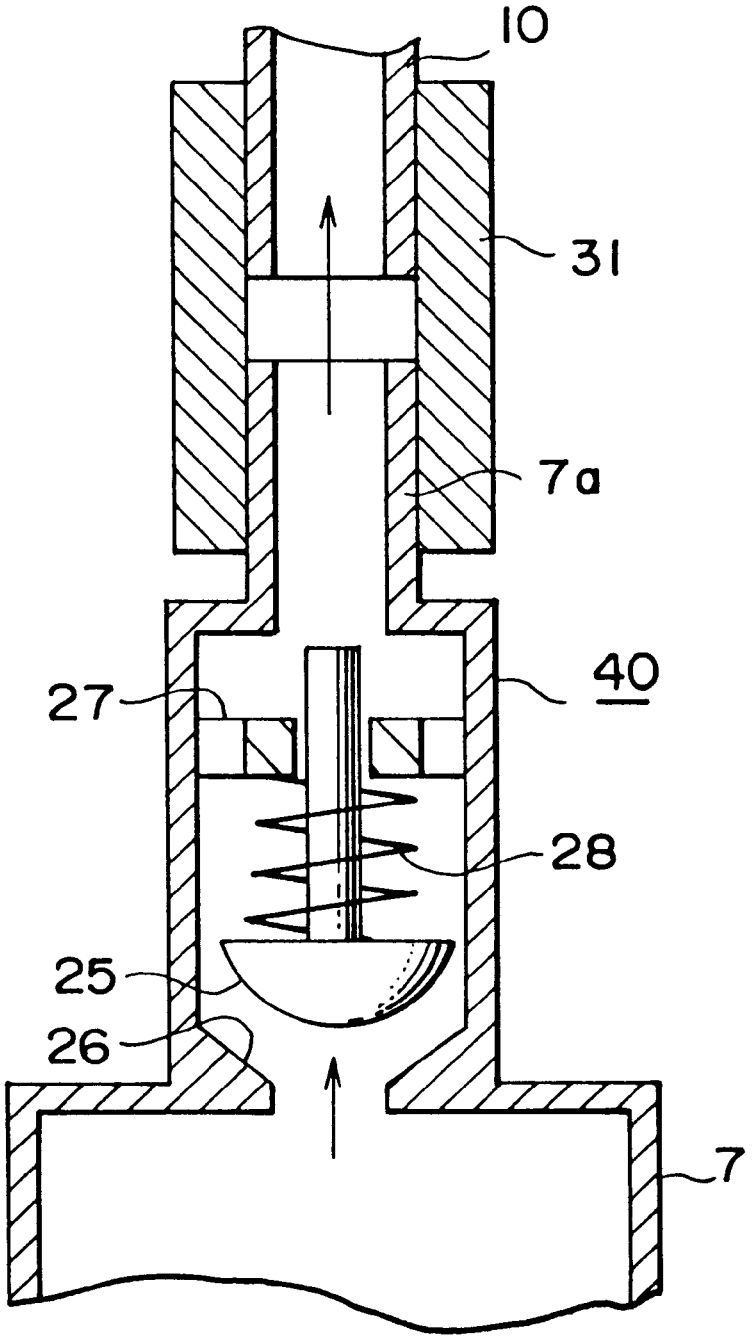
FIG. 6 is a sectional view of the fuel pump discharge port portion having a fuel flowing out prevention valve housed therein of the third embodiment of the present invention.
Figure 7:
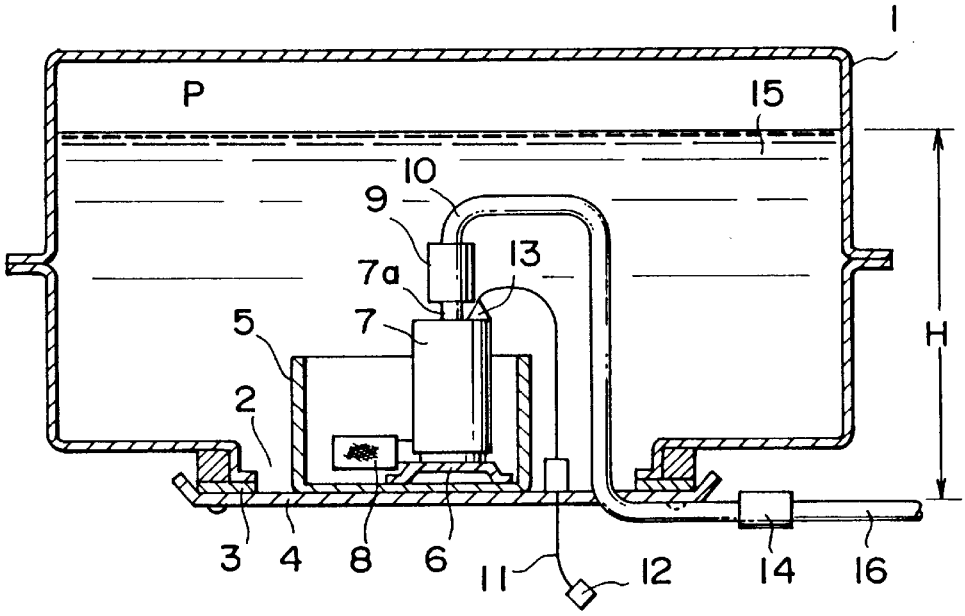
FIG. 7 PRIOR ART
FIG. 7 is a sectional side view of a conventional vehicular fuel supplying apparatus.
Figure 8:
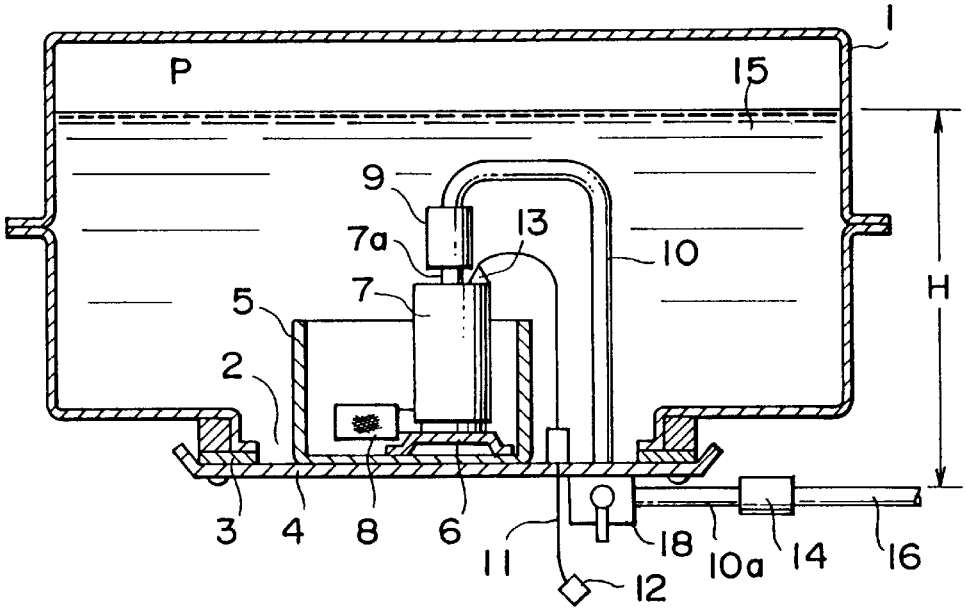
FIG. 8 PRIOR ART
FIG. 8 is a sectional side view of a conventional vehicular fuel supplying apparatus.

FIG. 5 is a sectional side view of the vehicular fuel supplying apparatus of the third embodiment of the present invention and FIG. 6 is a sectional view of the discharge port portion of the fuel pump in which the fuel flowing out prevention valve is housed. In the figures 1–16 and 25–28 are similar components to those explained in conjunction with the above first embodiment. 40 is a fuel flow prevention valve disposed inside of the discharge portion 7*a* of the fuel pump 7. The arrangement is such that the seal surface of the valve 25 can be brought into contact with the seal surface 26 of the side of the fuel pump 7, and is held in the flow path by a valve holder 27. Between the valve 25 and the valve holder 27, a coil spring 28 is disposed to urge the valve 25 against the seal surface 26. The valve opening pressure of the valve 25 due to the coil spring 28 is set to be greater than the total maximum value of the head pressure H of the fuel 15 inside of the fuel tank 1 and the pressure P of the inside of the fuel tank, and to be smaller than the fuel discharge pressure generated by the fuel pump 7. Therefore, the prevention of the flowing out of the fuel during the vehicle body maintenance and the prevention of failure of the fuel pump 7 due to the pressure increase within the supply pipe 10 can be achieved similarly as above described.

In this third embodiment, the outer housing member of the fuel flow prevention valve 40 can be made common to the outer housing member of the discharge port 7*a* of the fuel pump 7. Also, the supply pipe 10 is not needed to be divided into two in order to connect the fuel flow prevention valve 21 as in the first embodiment shown in FIG. 1 and the rubber hoses 24 for the connections are not needed. Thus, the third embodiment has an advantageous result that the number of the components or parts can be significantly decreased in addition to the advantages described in connection with the first embodiment.

What is claimed is:

1. A vehicular fuel supplying apparatus, comprising:

a fuel tank having a bottom wall;

a fuel pump, having a discharge port, mounted on said bottom wall of said fuel tank;

a vehicle body side pipe connected to an engine, wherein said fuel pump is connected to said engine via said vehicle body side pipe at a position below said fuel tank; and a fuel flow prevention valve mounted between said discharge port of said fuel pump and said vehicle body side pipe connected to said engine, wherein a valve opening pressure of said fuel flow prevention valve from a side of said fuel pump is greater than a total maximum value of a fuel head pressure of the inside of said fuel tank and a pressure of the inside of said fuel tank, and is smaller than a fuel discharge pressure generated by said fuel pump.

2. A vehicular fuel supplying apparatus as claimed in claim 1, further comprising a fuel filter disposed within said fuel tank and on the downstream of said discharge port of said fuel pump, and wherein said fuel flow prevention valve is disposed at a fuel outlet portion of said fuel filter.

3. A vehicular fuel supplying apparatus comprising:

a fuel tank having a bottom wall;

a fuel pump, having a discharge port, mounted on said bottom wall of said fuel tank;

a vehicle body side pipe connected to an engine, wherein said fuel pump is connected to said engine via said vehicle body side pipe at a position above said fuel tank; and a fuel flow prevention valve mounted within said discharge port of said fuel pump, wherein a valve opening pressure of said fuel flow prevention valve from the side of said fuel pump is greater than a total maximum value of a fuel head pressure of the inside of said fuel tank and a pressure of the inside of said fuel tank, and is smaller than a fuel discharge pressure generated by said fuel pump.

* * * * *